US008909074B2

(12) United States Patent
Yamada

(10) Patent No.: US 8,909,074 B2
(45) Date of Patent: Dec. 9, 2014

(54) FIXING DEVICE AND IMAGE FORMING APPARATUS INCLUDING SAME

(75) Inventor: Masamichi Yamada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 314 days.

(21) Appl. No.: 13/029,648

(22) Filed: Feb. 17, 2011

(65) Prior Publication Data

US 2011/0222874 A1 Sep. 15, 2011

(30) Foreign Application Priority Data

Mar. 12, 2010 (JP) ..... 2010-056735

(51) Int. Cl.
*G03G 15/20* (2006.01)

(52) U.S. Cl.
CPC ..... *G03G 15/2085* (2013.01); *G03G 15/2089* (2013.01)
USPC ..... 399/33; 399/122; 399/323; 399/329

(58) Field of Classification Search
USPC ..... 399/33, 45, 122, 323, 328, 329, 332
See application file for complete search history.

(56) References Cited

U.S. PATENT DOCUMENTS

| | | | | |
|---|---|---|---|---|
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,865,363 | B2 | 3/2005 | Hachisuka et al. | |
| 6,925,280 | B2 | 8/2005 | Yamada | |
| 7,228,096 | B2 * | 6/2007 | Yamada | 399/323 |
| 7,359,664 | B2 | 4/2008 | Yamada | |
| 7,751,768 | B2 | 7/2010 | Yamada | |
| 7,890,039 | B2 | 2/2011 | Yamada | |
| 2003/0016971 | A1 | 1/2003 | Kikuchi et al. | |

(Continued)

FOREIGN PATENT DOCUMENTS

| | | | |
|---|---|---|---|
| JP | 61-72274 | A | 4/1986 |
| JP | 63-293576 | A | 11/1988 |

(Continued)

OTHER PUBLICATIONS

Combined Chinese Office Action and Search Report Issued May 9, 2013 in Patent Application No. 201110057301.4 (with English translation of Categories of Cited Documents).

(Continued)

*Primary Examiner* — Hoang Ngo
(74) *Attorney, Agent, or Firm* — Oblon, Spivak, McClelland, Maier & Neustadt, L.L.P.

(57) ABSTRACT

A fixing device for fixing a toner image on a recording medium includes a fixing roller, a pressing roller, and at least one of a sheet guide, a sheet separation plate, and an electric component module. The fixing roller rotates in a predetermined direction of rotation. The pressing roller rotates and contacts an outer circumferential surface of the fixing roller to form a nip between the pressing roller and the fixing roller through which the recording medium bearing the toner image passes to fix the toner image by heat and pressure. The position of the pressing roller is changeable relative to the fixing roller. At least one of the sheet guide, the separation plate, and the electric component module moves in conjunction with movement of the pressing roller as a single integrated unit without changing relative positions with respect to the pressing roller.

14 Claims, 10 Drawing Sheets

(56) References Cited

U.S. PATENT DOCUMENTS

| | | | | |
|---|---|---|---|---|
| 2005/0008383 | A1* | 1/2005 | Tanaka et al. | 399/67 |
| 2007/0086814 | A1 | 4/2007 | Fujiwara | |
| 2008/0080909 | A1 | 4/2008 | Yamada | |
| 2009/0263170 | A1* | 10/2009 | Kagawa et al. | 399/329 |
| 2010/0189477 | A1 | 7/2010 | Yamada | |
| 2010/0226700 | A1 | 9/2010 | Yamada et al. | |
| 2010/0303523 | A1 | 12/2010 | Yamada | |
| 2011/0026986 | A1* | 2/2011 | Yamanaka et al. | 399/323 |

FOREIGN PATENT DOCUMENTS

| | | | |
|---|---|---|---|
| JP | 06-274066 | A | 9/1994 |
| JP | 7-219370 | A | 8/1995 |
| JP | 10-221987 | | 8/1998 |
| JP | 11-24485 | A | 1/1999 |
| JP | 2003-29564 | A | 1/2003 |
| JP | 2003-98889 | A | 4/2003 |
| JP | 2006-163017 | A | 6/2006 |
| JP | 2008-165091 | | 7/2008 |

OTHER PUBLICATIONS

Office Action issued on Oct. 22, 2013 in Japanese Patent Application No. 2010-056735.

Japanese Office Action issued May 13, 2014, in Japan Patent Application No. 2010-056735.

* cited by examiner

FIXING DEVICE AND IMAGE FORMING APPARATUS INCLUDING SAME

CROSS-REFERENCE TO RELATED APPLICATIONS

The present application is based on and claims priority to Japanese Patent Application No. 2010-056735, filed on Mar. 12, 2010 in the Japan Patent Office, which is hereby incorporated herein by reference in its entirety.

BACKGROUND OF THE INVENTION

1. Field of the Invention

Exemplary aspects of the present invention relate to a fixing device and an image forming apparatus such as a copier, printer, a facsimile machine, a plotter, and a multi-functional system including a combination thereof, and more particularly, to a fixing device for fixing a toner image on a recording medium, and an image forming apparatus including the fixing device.

2. Description of the Related Art

Related-art image forming apparatuses, such as copiers, facsimile machines, printers, plotters, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressing member"). In a fixing process, the fixing member and the pressing member meet and press against each other, forming a so-called a fixing nip through which a recording medium is passed to fix a toner image thereon under heat and pressure.

To extend product life of the fixing member, which is subjected to constant heat and pressure, changing the position of the pressing member is proposed. More specifically, the position of the pressing member is changed between a pressing state and a pressure-free state by rotating a cam so that the pressing member is not always in contact with the fixing member. The position of the pressing member is also changed deliberately to accommodate recording media sheets in different types and sizes. Further, the position of the pressing member is changed to change an extent of contact between the fixing member and the pressing member, that is, a width of the nip and a nip pressure in accordance with the recording medium fed to the nip.

Some fixing devices are provided with a sheet guide to guide the recording medium properly to the nip and a sheet separator to facilitate separation of the recording medium from the pressing member after the nip at a certain position. If not properly positioned, the recording medium fails to be conveyed properly to the nip or separated from the pressing member. In the fixing device using a movable pressing member to change the nip width and the nip pressure as described above, changes in the position of the pressing member complicate efforts to properly position the sheet guide and the sheet separator relative to the pressing member, causing possible failure in the fixing operation of the toner image and in conveyance of the recording medium.

In this type of the fixing device, the pressing member is heated by a heater, and the temperature of the pressing member is adjusted by detecting the temperature of a surface of the pressing member by a temperature detector. In this configuration, changes in the position of the pressing member causes misalignment of the pressing member relative to the temperature detector, complicating efforts to detect and adjust the temperature of the pressing member correctly, ultimately causing fixing failure. Similarly, when provided with a thermostat and/or a temperature fuse, changes in the position of the pressing member also cause misalignment of the thermostat and the fuse relative to the pressing member, hindering reliable prevention of overheating of the pressing member.

BRIEF SUMMARY OF THE INVENTION

In view of the foregoing, in one illustrative embodiment of the present invention, a fixing device for fixing a toner image on a recording medium includes a fixing roller, a pressing roller, and at least one of a sheet guide, a sheet separation plate, and an electric component module. The fixing roller rotates in a predetermined direction of rotation. The pressing roller rotates and contacts an outer circumferential surface of the fixing roller to form a nip between the pressing roller and the fixing roller through which the recording medium bearing the toner image passes to fix the toner image on the recording medium with heat and pressure. The position of the pressing roller is changeable relative to the fixing roller. The sheet guide is disposed upstream from the nip in the direction of conveyance of the recording medium, to guide the recording medium to the nip.

The sheet separation plate is disposed downstream from the nip in the direction of conveyance of the recording medium, to separate the recording medium from the pressing roller. At least one of the sheet guide, the separation plate, and the electric component module moves in conjunction with movement of the pressing roller as a single integrated unit without changing relative positions with respect to the pressing roller.

In another illustrative embodiment of the present invention, an image forming apparatus includes the fixing device.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
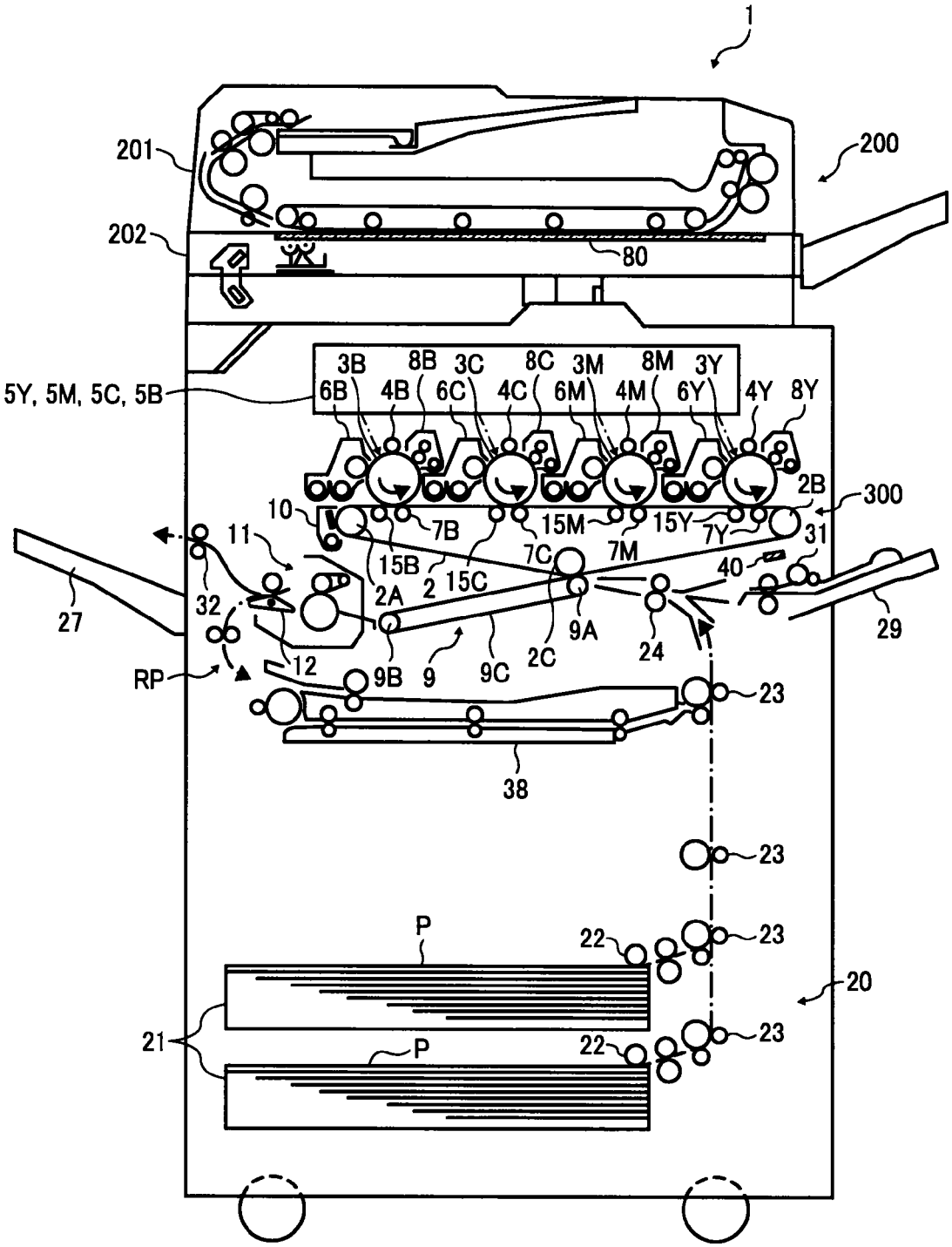
FIG. 1 is a schematic diagram illustrating an image forming apparatus according to an exemplary embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, a tandem-type image forming apparatus according to an exemplary embodiment of the present invention is explained.

Referring to FIG. 1, there is provided a schematic diagram illustrating a color copier as an example of the image forming apparatus.

As illustrated in FIG. 1, an image forming apparatus 1 includes an image forming unit 300, a sheet feeding unit 20 substantially below the image forming unit 300, and an image reader 200 substantially above the image forming unit 300. The image forming unit 300 includes an intermediate transfer belt 2 having a transfer surface extending horizontally on which a toner image is transferred, and photoconductive drums 3Y, 3M, 3C, and 3B serving as image carriers arranged in tandem along the intermediate transfer belt 2 facing the transfer surface of the intermediate transfer belt 2. It is to be noted that reference characters Y, M, C, and B denote the colors yellow, magenta, cyan, and black, respectively. To simplify the description, the reference characters Y, M, C, and B indicating colors are omitted herein unless otherwise specified.

The photoconductive drums 3Y, 3M, 3C, and 3B rotate in a counterclockwise direction. Around each of the photoconductive drums 3Y, 3M, 3C, and 3B, a charging device 4, an optical writer 5, a developing device 6, a transfer bias roller 7, a voltage applicator 15, a cleaning device 8 are disposed. The charging device 4 charges the respective photoconductive drum 3 while the photoconductive drum 3 is rotated. The optical writer 5 serves as an exposure device to form an electrostatic latent image on the respective photoconductive drum 3 based on image information read by the image reader 200. The developing device 6 develops the electrostatic latent image formed on the photoconductive drum 3 with toner having the same polarity as that of the electrostatic latent image. The transfer bias roller 7 serves as a primary transfer member. In each of the developing devices 6, the respective color of toner is stored.

The intermediate transfer belt 2 is rotatably wound around and stretched between a plurality of rollers 2A, 2B, and 2C disposed in the inner loop of the intermediate transfer belt 2. The intermediate transfer belt 2 rotates in the same direction as that of the photoconductive drums 3Y, 3M, 3C, and 3B at the position facing each other. The rollers 2A and 2B support the transfer surface of the intermediate transfer belt 2. The roller 2C is disposed facing a secondary transfer unit 9 through the intermediate transfer belt 2. The image forming apparatus also includes a belt cleaning unit 10.

The photoconductive drums 3Y, 3M, 3C, and 3B all have the same configuration as all the others, differing only in the color of toner employed. Thus, a description is provided of the photoconductive drum 3Y as a representative example of the photoconductive drums. The surface of the photoconductive drum 3Y is charged uniformly by the charging device 4Y. An electrostatic latent image is formed on the photoconductive drum 3Y based on the image information read by the image reader 200.

The electrostatic latent image formed on the photoconductive drum 3Y is developed with yellow toner by the developing device 6Y to form a visible image, also known as a toner image. The developing device 6Y stores a two-component developing agent consisting of carrier and toner. Subsequently, the toner image is primarily transferred from the photoconductive drum 3Y onto the intermediate transfer belt 2 due to an electric field created by the voltage applied to the transfer bias roller 7Y.

The voltage applicator 15Y is disposed upstream from the transfer bias roller 7Y in the direction of rotation of the photoconductive drum 3Y. The voltage applicator 15Y applies a voltage same as the polarity of the photoconductive drum 3Y and an absolute value greater than when printing a solid image, to the intermediate transfer belt 2, thereby preventing toner from getting transferred undesirably from the photoconductive drum 3Y to the intermediate transfer belt 2 before the toner image enters a transfer area and thus preventing degradation of imaging quality.

Similarly, image forming operation similar to the photoconductive drum 3Y is performed with regards to the photoconductive drums 3M, 3C, and 3B, and toner images of the respective color are overlappingly transferred onto the intermediate transfer belt 2, forming a composite color toner image.

After the transfer process, toner (residual toner) remaining on the photoconductive drums 3 is removed therefrom by the cleaning device 8. In the meantime, the potential of the photoconductive drums 3 is initialized by a charge eraser after the transfer process in preparation for the subsequent imaging cycle.

The secondary transfer unit 9 includes a transfer belt 9C wound around and stretched between a drive roller 9A serving as a charger and a driven roller 9B. The transfer belt 9C moves in the same direction as that of the intermediate transfer belt 2. The drive roller 9A charges the transfer belt 9C to transfer the composite toner image formed on the intermediate transfer belt 2 onto a recording medium P.

Multiple recording media sheets P are stored in sheet cassettes 21 of the sheet feed unit 20 and fed to a secondary transfer position. An uppermost recording medium P in one of the sheet cassettes 21 is picked up by a pickup roller 22 and conveyed to sheet feed roller pairs 23 which guide the recording medium P to a registration roller pair 24 which is disposed upstream from the secondary transfer position.

The recording medium P fed from the sheet cassette 22 is temporarily stopped at the registration roller pair 24 at which the position of the recording medium P is aligned. Subsequently, the recording medium P is sent to the secondary transfer position in appropriate timing such that the recording medium P is aligned with the toner image on the intermediate transfer belt 2.

A manual feed tray 29 is foldably disposed at the right side of the image forming apparatus 1. When manually fed, the recording medium P placed on the manual feed tray 29 is conveyed to the registration roller pair 24 by a sheet feed roller 31 through the same sheet conveyance path through which the recording medium P conveyed from the sheet cassette 21 also passes.

The optical writers 5Y, 5M, 5C, and 5B illuminate the respective photoconductive drums 3Y, 3M, 3C, and 3B with light based on image information received from the image reader 200 or a computer, thereby forming electrostatic latent images on the photoconductive drums 3Y, 3M, 3C, and 3B.

The image reader 200 includes an automatic document feeder 201 and a scanner 202 which includes a contact glass 80 on which a recording medium P is placed. The automatic document feeder 201 can reverse a document to be conveyed to the contact glass 80 so that both sides of the document are scanned.

The electrostatic latent images formed on the photoconductive drums 3 by the respective optical writers 5 are developed with respective color of toner by the developing devices 6, thereby forming a visible image, also known as a toner image, on the photoconductive drums 3. Subsequently, the toner images are overlappingly and primarily transferred onto the intermediate transfer belt 2, forming a composite toner image. Then, the secondary transfer unit 9 secondarily transfers the composite toner image onto the recording medium P. The recording medium P bearing the toner image is sent to a fixing device 11 in which the toner image, also called an unfixed image, is fixed onto the recording medium P by heat and pressure.

The residual toner remaining on the intermediate transfer belt 2 after the secondary transfer process is cleaned by the belt cleaning device 10.

The recording medium P passed through the fixing device 11 is guided to either a conveyance path leading to a catch tray 27 or a reverse path RP by a switching claw 12. In a case in which the recording medium P is conveyed to the catch tray 27, the recording medium P is discharged to and stacked on the catch tray 27 by a pair of discharge rollers 32. By contrast, in a case in which the recording medium P is conveyed to the reverse path RP, the recording medium P is turned by a sheet reverse unit 38 and is sent to the registration roller pair 24.

When forming a single-color image, a single-color toner image is transferred on the intermediate transfer belt 2 and then transferred onto the recording medium P fed from the sheet cassette 21. By contrast, when forming a multi-color toner image, toner images of different colors are overlappingly transferred onto the intermediate transfer belt 2 and then transferred secondarily onto the recording medium P. After the secondary transfer process, the unfixed toner image is fixed by the fixing device 11 and discharged onto the catch tray 27, or is reversed for forming an image on the other side of the recording medium P.

It is to be noted that a reference number 40 refers to a density detector to detect a density of the toner pattern.

Figure 2:
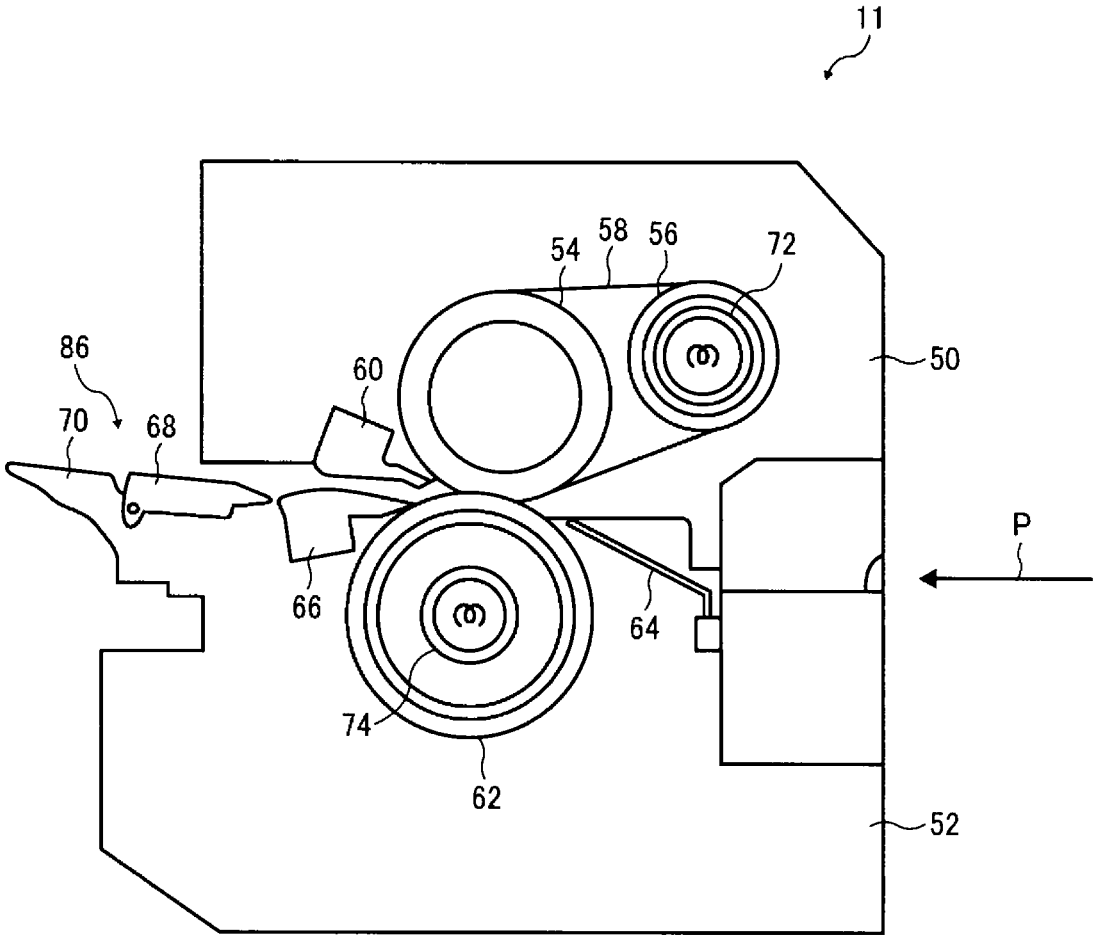
FIG. 2 is a schematic diagram illustrating a fixing device according to an illustrative embodiment of the present invention, employed in the image forming apparatus shown in FIG. 1.

With reference to FIGS. 1 and 2, a description is provided of a fixing device 11 according to the illustrative embodiment of the present invention. FIG. 2 is a schematic diagram illustrating the fixing device 11, according to the illustrative embodiment of the present invention.

As illustrated in FIG. 2, the fixing device 11 includes an upper unit 50 and a lower unit 52. The upper unit 50 includes a first separation plate 60, a fixing roller 54, a heating roller 56, a fixing belt 58 wound around and stretched between the fixing roller 54, the heating roller 56, and so forth.

The lower unit 52 includes a pressing roller 62, a sheet guide 64, a second separation plate 66 serving as a sheet separator for separating a recording medium rolled around the pressing roller 62, a sheet discharge assembly 86 serving as a sheet discharger, and so forth. The sheet discharge assembly 86 includes a relay guide 68 and a sheet discharge guide 70. The second separation plate 66, the relay guide 68, the sheet discharge guide 70 have a length similar to, if not the same as, a shaft of the pressing roller 62, extending in an axial direction of the pressing roller 62. The positions of the sheet guide 64 and the second separation plate 66 relative to the pressing roller 62 do not change even when the pressing roller 62 moves.

The pressing roller 62 is pressed against the fixing roller 54 through the fixing belt 58, thereby forming a nip between the pressing roller 62 and the fixing belt 58 through which a recording medium P is conveyed. A halogen heater 72 serving as a heat source is disposed in the heating roller 56. A halogen heater 74 is disposed in the pressing roller 62. The recording medium P bearing an unfixed toner image is conveyed to the nip from the right side in FIG. 2. In the nip, heat and pressure are applied to the recording medium, thereby fixing the unfixed toner image on the recording medium.

The fixing belt 58 includes a base layer formed of polyimide resin having an internal diameter of approximately 80 mm and a thickness of approximately 90 μm. A silicon rubber layer having a thickness of approximately 200 μm is provided on the base layer. The silicon rubber layer is coated with tetrafluoroethylene-perfluoroalkylvinylether copolymer (hereinafter PFA) having a thickness of approximately 20 μm as an outermost surface.

The fixing roller 54 includes a heat-resistant elastic layer formed of, for example, silicon rubber having an outer diameter of approximately 52 mm and a thickness of approximately 14 mm.

The heating roller 56 is constructed of a metal hollow tube, for example, an aluminum tube, having an outer diameter of approximately 40 mm and a thickness of approximately 0.6 mm.

The pressing roller 62 is constructed of a metal core including metal material such as copper having a thickness of approximately 1 mm and an outer diameter approximately 65 mm. On the metal core, a silicon rubber layer having a thickness of approximately 1.5 mm is provided. On the silicon rubber layer, a tube made of PFA is provided.

Figure 3:
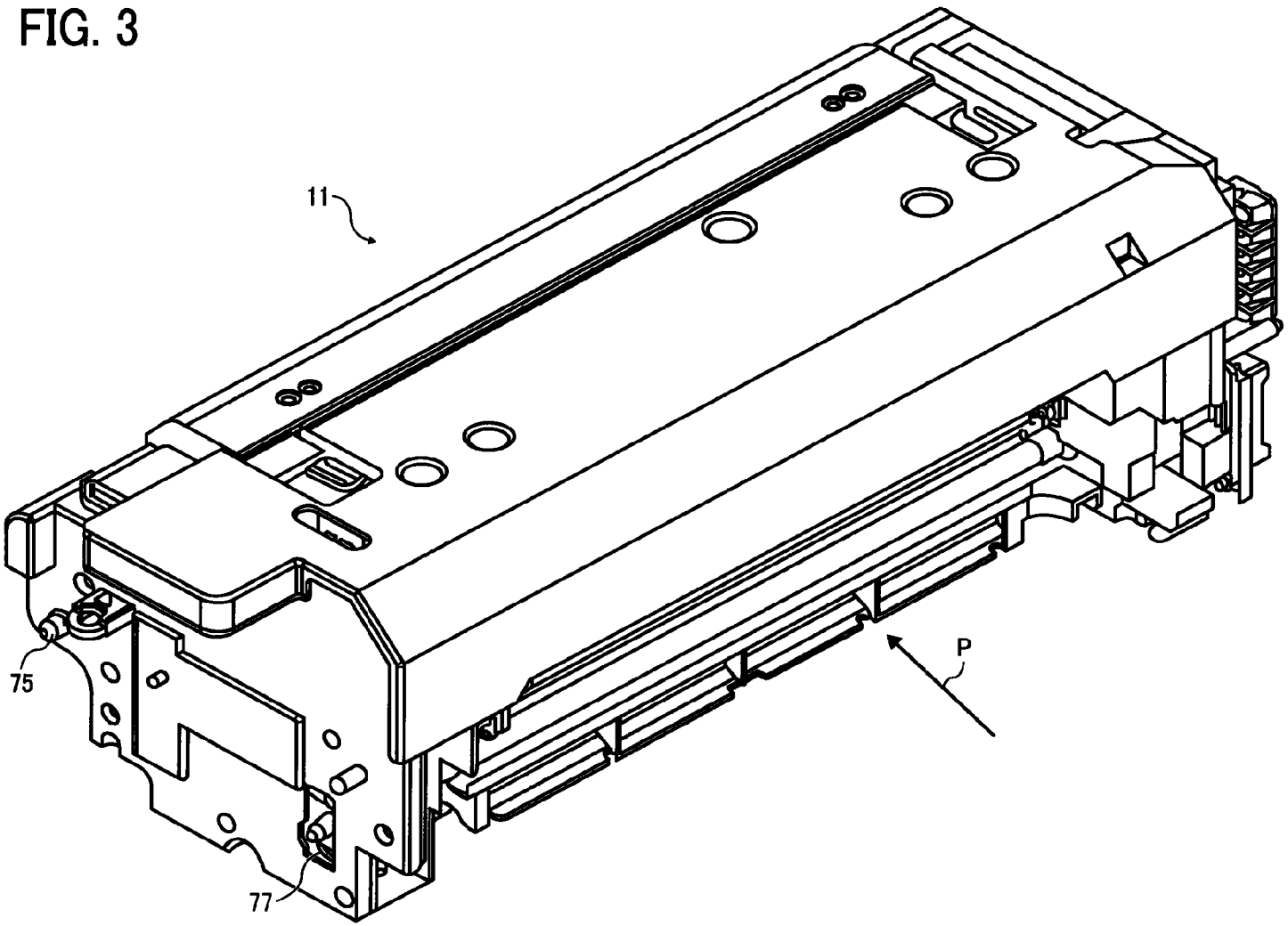
FIG. 3 is an external perspective view of the fixing device of FIG. 2.
Figure 4:
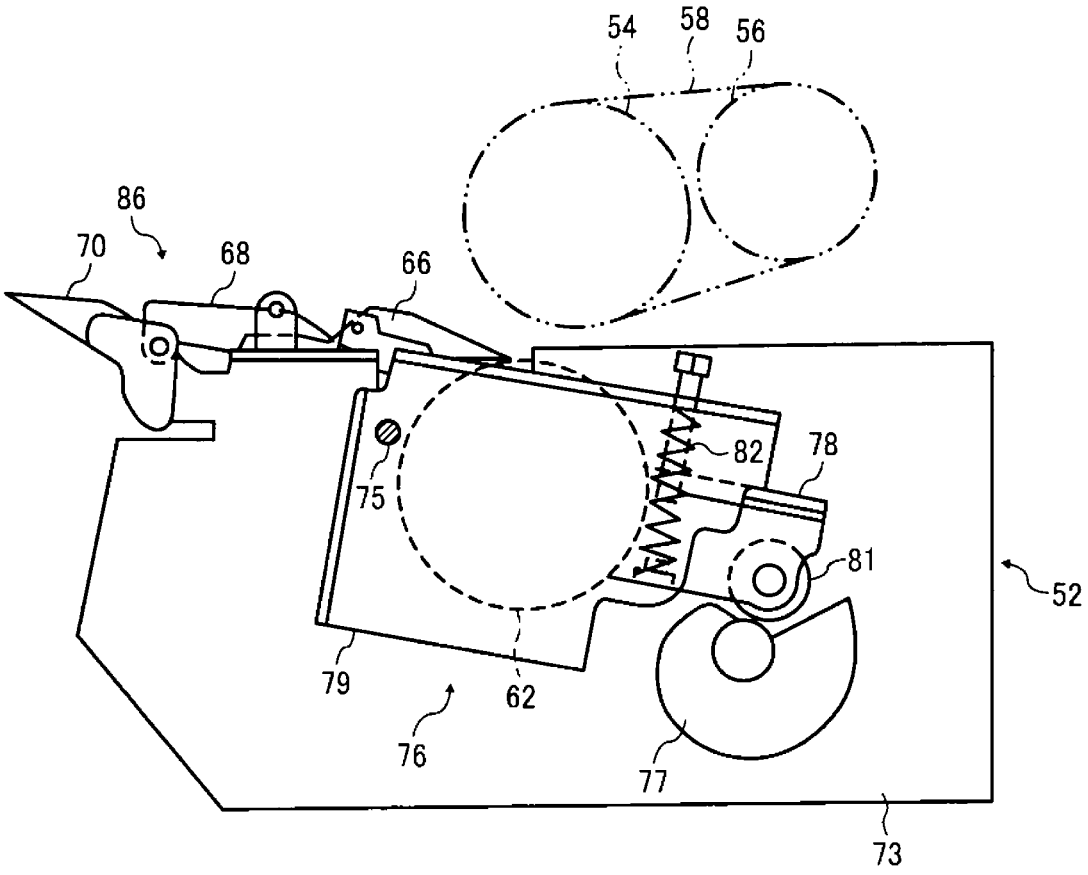
FIG. 4 is a schematic diagram illustrating a lower unit of the fixing device in a pressure-free state.

With reference to FIGS. 3 and 4, a description is provided of the fixing device 11 in more detail. FIG. 3 is an external perspective view of the fixing device 11. FIG. 4 is a schematic diagram illustrating the lower unit 52 of the fixing device 11 in a pressure-free state when the pressing roller 62 is separated from the fixing belt 58. "No-pressure state" herein refers to either the pressing roller 62 being separated from the fixing belt 58 or the pressing roller 62 contacting the fixing belt 58 with no pressure.

In FIG. 4, the lower unit 52 of the fixing device 11 includes a lower frame 73 and a pressing roller assembly 76. The position of the lower frame 73 is fixed. The pressing roller assembly 76, provided to the lower frame 73, holds the pressing roller 62, and is vertically rotatable about a shaft 75. The pressing roller assembly 76 is rotated by a cam 77 provided to the lower frame 73.

The cam 77 is rotated by a drive source. The cam 77 is rotated in a clockwise direction, enabling the pressing roller assembly 76 to rotate upward so that the pressing roller 62 contacts the fixing roller 54 with pressure. When the cam 77 is rotated in an opposite direction, the pressing roller 62 does not press the fixing roller 54.

The pressing roller assembly 76 includes an internal lever (a first lever) 78 and an external lever (a second lever) 79. The internal lever 78 is driven directly by the cam 77. The external lever 79 supports the pressing roller 62. Both the internal lever 78 and the external lever 79 rotate about the shaft 75.

The internal lever 78 includes a bearing 81 serving as a roller that contacts the cam surface of the cam 77. The pressing roller assembly 76 includes the second separation plate 66. The pressing roller assembly 76 and the second separation plate 66 are constituted as a single integrated member. The sheet discharge assembly 86 is provided to the lower frame 73.

Figure 5:
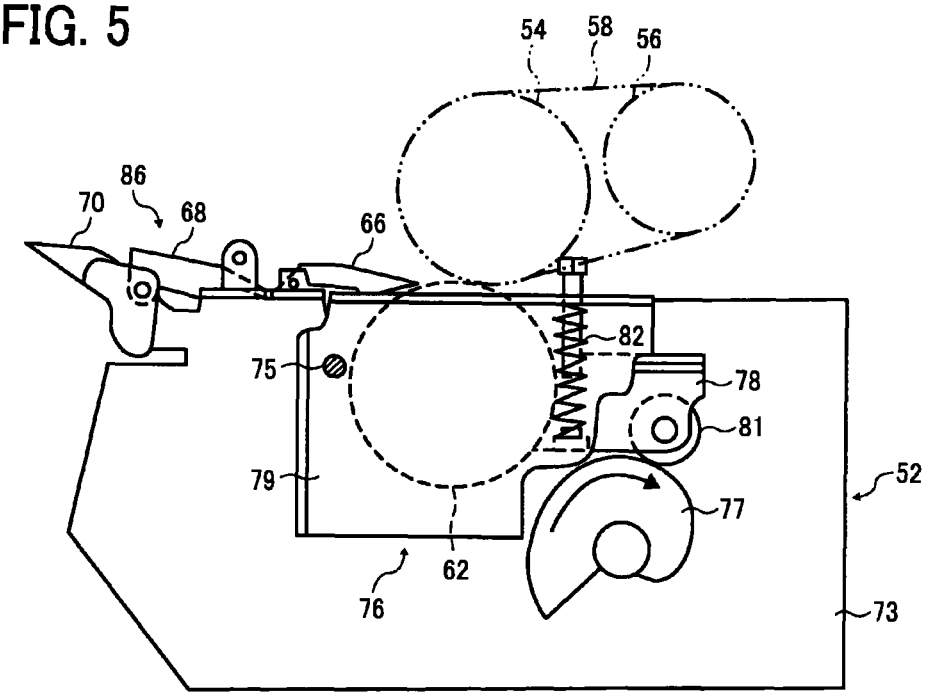
FIG. 5 is a schematic diagram illustrating the lower unit of FIG. 4 in a first pressing state in which a thin recording medium, a no-coating sheet, and the like is fixed.

The cam 77 has a shape that allows the cam surface to rise gradually as the cam 77 rotates in the direction indicated by an arrow in FIG. 5. Rotation of the cam 77 adjusts an extent of engagement of the pressure roller 62 against the fixing roller 54 through the fixing belt 58 and a width of the nip steplessly.

A coil spring 82 serving as an elastic member is provided between the internal lever 78 and the external lever 79. The coil spring 82 acts in the direction of the pressing roller 62 pressing against the fixing roller 54 when the pressing roller 62 contacts the fixing roller 54 to press against the fixing roller 54. A description of the coil spring 82 is provided later.

Rotation of the cam 77 in the clockwise direction in the state illustrated in FIG. 4, that is, in the pressure-free state, causes the pressing roller assembly 76 to rotate in the counterclockwise direction about the shaft 75 as illustrated in FIG. 5, enabling the pressing roller 62 to pressingly contact the fixing roller 54 through the fixing belt 58, forming the nip therebetween. FIG. 5 is a schematic diagram illustrating the lower unit 52 of the fixing device 11 in a first pressing state suitable for fixing, for example, a thin recording medium, a no-coating sheet, and the like.

A detector is provided to detect a home position of the cam 77. An amount of rotation of the cam 77 is obtained based on how much the cam 77 is rotated from its home position. Based on the amount of rotation from the home position, the "pressure-free" state is changed to the first pressing state. For example, if a stepping motor is employed as the drive source for the cam 77, the number of steps is detected.

Figure 6:
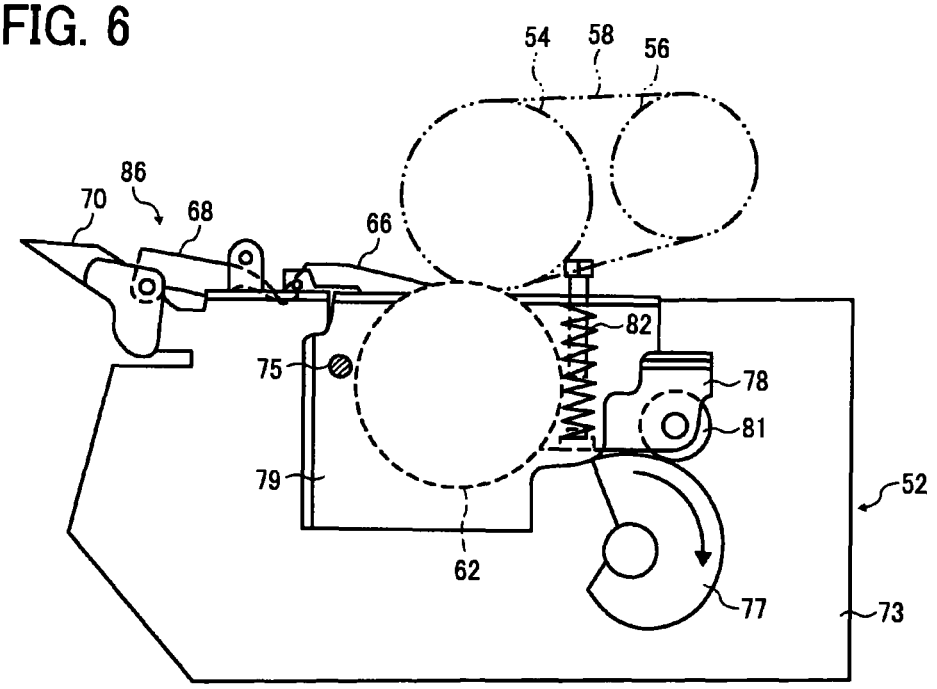
FIG. 6 is a schematic diagram illustrating the lower unit of the fixing device in a second pressing state in which a relatively thick recording medium, a coat sheet, and the like is fixed.

Furthermore, when the cam 77 is rotated in the clockwise direction further, the amount of engagement of the pressing roller 62 relative to the fixing roller 54 increases, thereby increasing the nip width as illustrated in FIG. 6. FIG. 6 is a schematic diagram illustrating the lower unit 52 of the fixing device 11 in a second pressing state suitable for fixing, for example, a relatively thick recording medium, a coat sheet, and the like. The similar, if not the same operation as described above is performed to change the first pressing state to the second pressing state.

Figure 7:
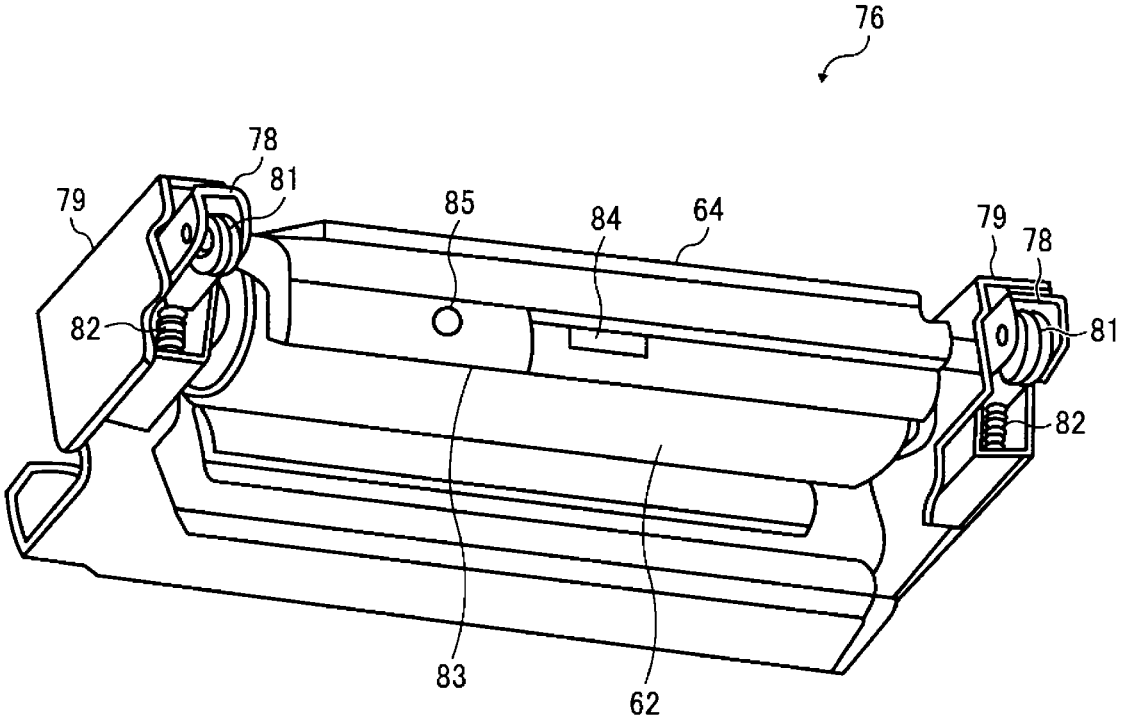
FIG. 7 is a perspective view of a pressing roller assembly of the fixing device as viewed from the bottom thereof.

The pressing roller assembly 76 is detachable from the lower frame 73 of the lower unit 52 of the fixing device 11 as illustrated in FIG. 7. FIG. 7 is a perspective view of the pressing roller assembly 76 as viewed from the bottom thereof. As illustrated in FIG. 7, the internal lever 78, the external lever 79, the bearing 81, the coil spring 82, and the cam 77 (shown in FIGS. 4, 5, and 6) for rotation of the pressing roller assembly 76 are disposed substantially at both ends of the shaft of the pressing roller 62 in the axial direction.

As described above, the pressing roller assembly 76 includes the sheet guide 64, the second separation plate 66, and an electric component module 83. The sheet guide 64, the second separation plate 66 serving as a sheet separator, and the electric component module 83 may constitute a single integrated unit as the pressing roller assembly 76 so that the relative positions thereof with respect to the pressing roller 62 do not change even when the pressing roller 62 moves.

The electric component module 83 includes a contactless thermistor 84 and a thermostat 85. The thermistor 84 is a temperature detector to detect the temperature of the surface of the pressing roller 62. The thermostat 85 prevents the pressing roller 62 from getting overheated. The relative positions of the thermistor 84 and the thermostat 85 with respect to the pressing roller 62 do not change even when the pressing roller 62 moves.

The sheet guide 64, the second separation plate 66, the thermistor 84, and the thermostat 85 are positioned in place relative to the pressing roller 62, to perform optimally. Because the sheet guide 64, the second separation plate 66, the thermistor 84, the thermostat 85, and the pressing roller 62 constitute a single integrated unit, the relative positions of these devices do not change even when the position of the pressing roller 62 changes in accordance with types of recording media.

With this configuration, transportability of the sheet guide 64, the separation performance of the second separation plate 66, the detection performance of the thermistor 84, and the performance of the thermostat 85 for prevention of overheat are assured regardless of the position of the pressing roller 62.

Figure 8:
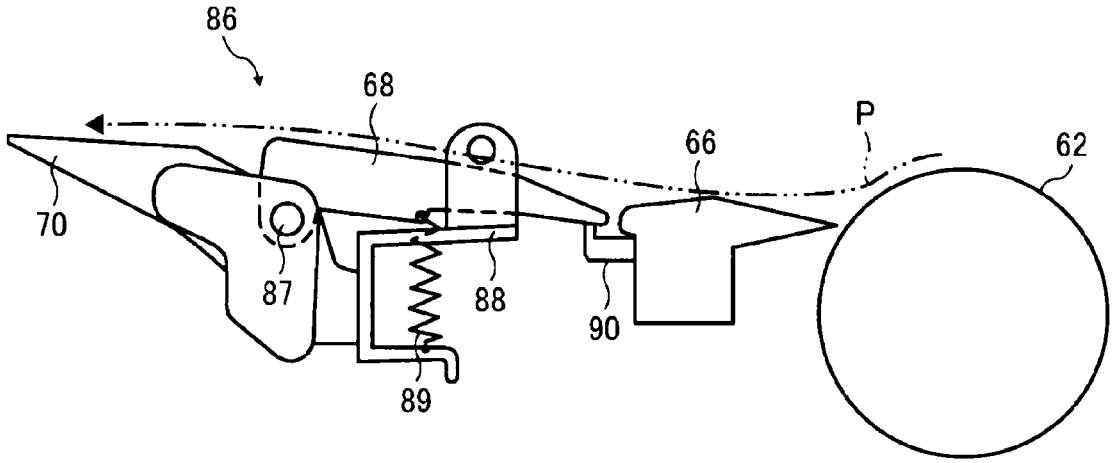
FIG. 8 is a schematic diagram illustrating a relative position of a pressing roller and a sheet discharge assembly according to the illustrative embodiment of the present invention.
Figure 9:
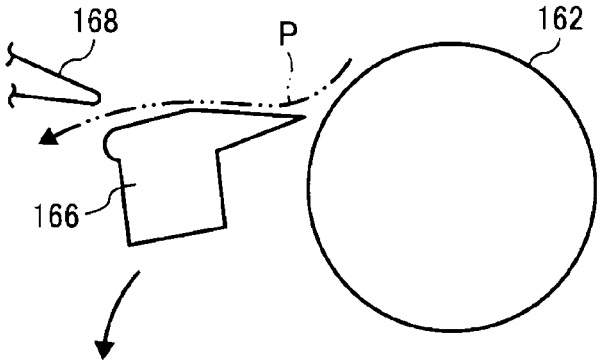
FIG. 9 RELATED ART
FIG. 9 is a schematic diagram illustrating a related-art pressing roller and a sheet discharge assembly.

Referring now to FIGS. 8 and 9, a description is provided of movement of the pressing roller 62, the second separation plate 66, and the relay guide 68 changing from the first pressing state to the second pressing state. FIG. 8 is a schematic diagram illustrating a relative position of the pressing roller 62 and the sheet discharge assembly 86 according to the illustrative embodiment of the present invention. FIG. 9 is a schematic diagram illustrating a related-art pressing roller and a sheet discharge assembly.

In order to facilitate an understanding of the related art and of the novel features of the present invention, with reference to FIG. 9, a description is provided of a difficulty encountered in the related art pressing roller and the sheet discharge assembly. When changing from the first pressing state to the second pressing state, a pressing roller assembly rotates in a counterclockwise direction about a shaft similar to that as described above. A pressing roller 162 moves toward a fixing roller. By contrast, a second separation plate 166, which moves in conjunction with the pressing roller 162 without changing its position between the second separation plate 166 and the pressing roller 162, separates from the fixing roller. Consequently, as illustrated in FIG. 9, when a relay guide 168 remains in the first pressing state, a downstream end of the second separation plate 166 in the direction of conveyance of the recording medium comes under an upstream end of the relay guide 168, creating an undesirable gap between the relay guide 168 and the second separation plate 166 through which the recording medium passes, causing a paper jam.

In view of the above, according to the illustrative embodiment, the relay guide 68 moves in conjunction with the second separation plate 66 to secure reliably a sheet conveyance path to prevent a paper jam both in the first pressing state and the second pressing state when discharging the recording medium. As illustrated in FIG. 8, the downstream end of the relay guide 68 in the direction of the conveyance direction of the recording medium is supported by a shaft 87 and rotates vertically. In other words, the relay guide 68 is rotatably provided to the lower frame 73. The sheet discharge assembly 86 is provided to a mounting portion 88 of the lower frame 73.

As illustrated in FIG. 8, a tension spring 89 is disposed between the mounting portion 88 and the relay guide 68 to pull the relay guide 68 downward (in the clockwise direction). A stopper 90 is provided to the downstream end of the second separation plate 66 in the direction of conveyance of the recording medium P. The stopper 90 contacts the upstream end of the relay guide 68. A plurality of the stoppers 90 are provided along the longitudinal direction of the second separation plate 66 at predetermined intervals.

As described above, even when rotation of the pressing roller assembly 76 causes the second separation plate 66 to separate from the fixing roller 54, the relay guide 68 is pulled by the tension spring 89 to prevent a gap from appearing between the second separation plate 66 and the relay guide 68, thereby forming a smooth sheet conveyance path. With this configuration, the recording medium P is discharged reliably in both the first pressing state and the second pressing state.

According to the present embodiment, the relay guide 68 is biased in the clockwise direction. Alternatively, the relay guide 68 may rotate under its own weight so that the upstream end thereof contacts the stopper 90. Still alternatively, the upstream end of the relay guide 68 and the downstream end of the second separation plate 66 may be connected such that the change in the position is absorbed.

Figure 10:
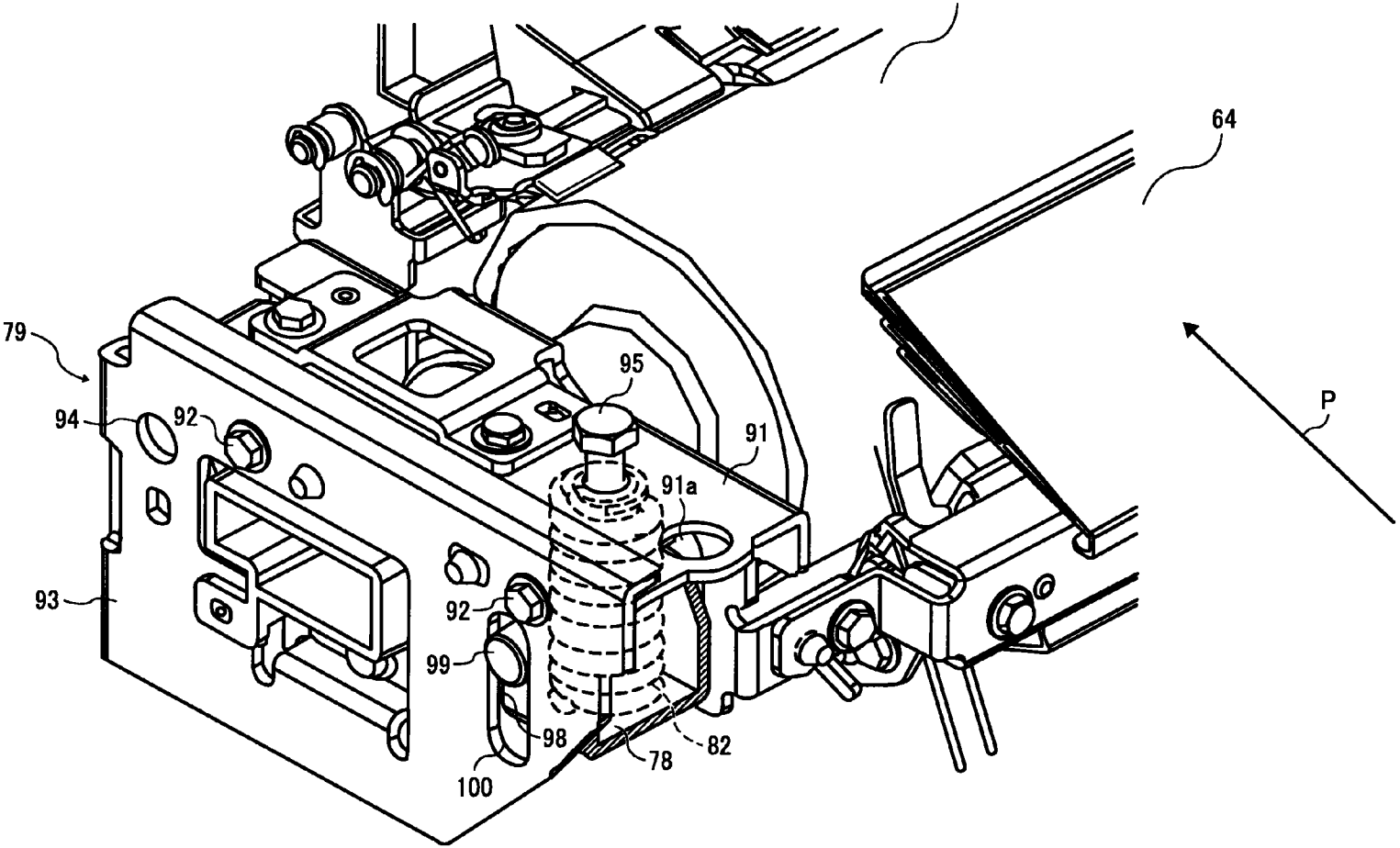
FIG. 10 is a schematic perspective view of a rotation mechanism of the pressing roller assembly according to the illustrative embodiment of the present invention.
Figure 11:
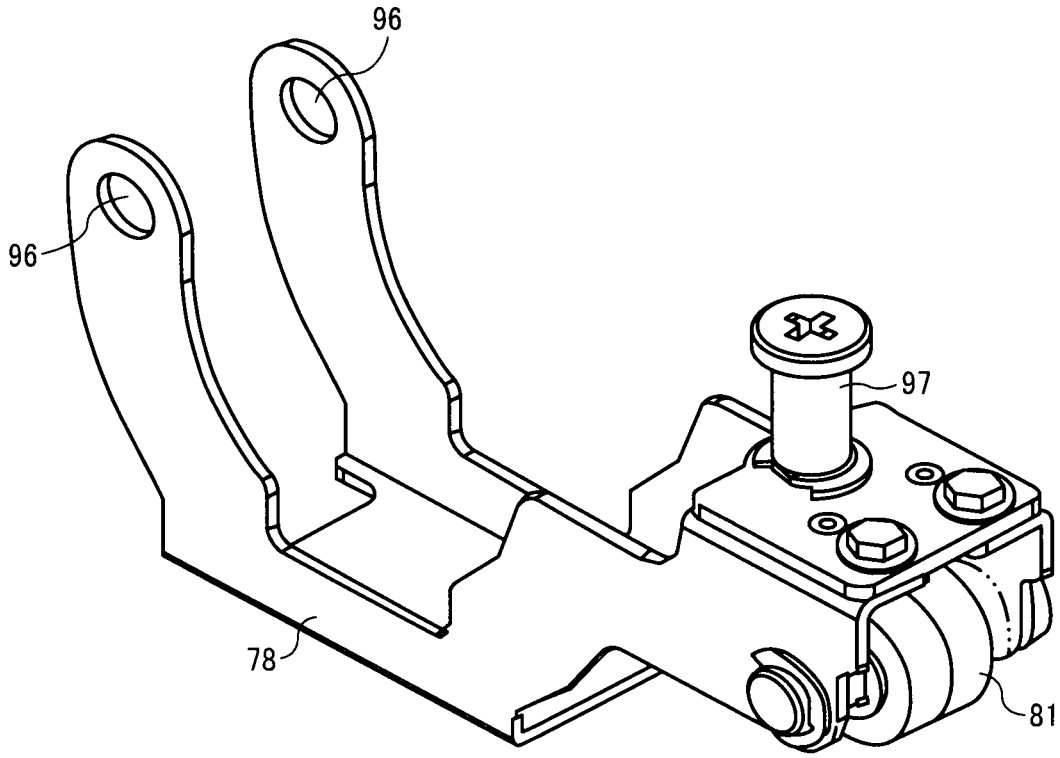
FIG. 11 is a schematic perspective view of an internal lever of the pressing roller assembly according to the illustrative embodiment of the present invention.
Figure 12:
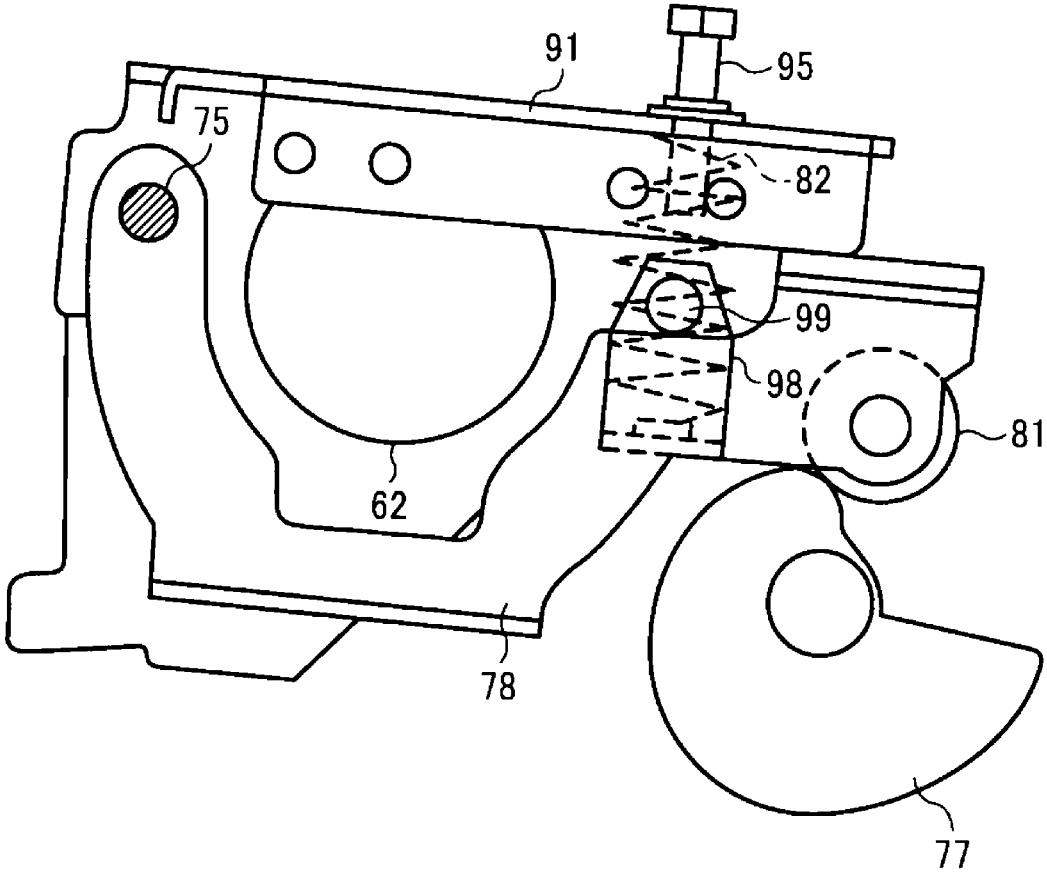
FIG. 12 is a schematic diagram illustrating a biasing mechanism according to the illustrative embodiment of the present invention.

Referring now to FIGS. 10 through 12, a description is provided of a configuration of the internal lever 78 and the external lever 79 that enable rotation of the pressing roller assembly 76 using the cam 77, and a biasing mechanism of the coil spring 82 according to the illustrative embodiment. FIG. 10 is a schematic perspective view of a rotation mechanism of the pressing roller assembly 76. FIG. 11 is a schematic perspective view of the internal lever 78. FIG. 12 is a schematic diagram illustrating a biasing mechanism including the internal lever 78 and the external lever 79.

As illustrated in FIG. 10, the external lever 79 includes an internal plate 91, an external plate 93, and a bolt 92. The internal plate 91 holds both end portions of the fixing roller 62 through a shaft bearing. The external plate 93 is fixed to the internal plate 91 by the bolt 92. Both the internal plate 91 and the external plate 93 include a through hole 94 through which the shaft 75 is inserted. A bolt 95 is thrededly connected to the upper surface of the internal plate 91 of the external lever 79 into the coil spring 82 to support the coil spring 82. The bold 95 serves as a shaft to support the coil spring 82 and also as a stopper to regulate the upper limit position of the external lever 79. It is to be noted that the internal lever 78 is partially illustrated in FIG. 10.

With reference to FIG. 11, a description is provided of the internal lever 78. The internal lever 78 includes through holes 96 through which the shaft 75 is inserted, similar to the external lever 79. The internal lever 78 and the external lever 79 are connected by a screw shaft 97 inserted to a hole 91*a* (shown in FIG. 10) formed on the upper surface of the internal plate 91. The internal lever 78 and the external lever 79 are connected with a certain clearance.

As illustrated in FIG. 12, a spring washer 98 for the coil spring 82 is fixed inside the internal lever 78. A shaft pin 99 is fixed to the spring washer 98 such that the shaft pin 99 projects horizontally outside. The shaft pin 99 engages an elongate hole 100 (shown in FIG. 10) formed on the external plate 93 of the external lever 79. With this configuration, a degree of shift of the internal lever 78 and the external lever 79 due to a positional change of the pressing roller 62 is regulated. As illustrated in FIG. 12, the coil spring 82 is disposed between the spring washer 98 and the upper surface of the internal plate 91.

The internal lever 78 is directly and rotatably driven by the cam 77. In other words, the cam 77 changes the lowest end position of the coil spring 82.

When the cam 77 is rotated in the clockwise direction as described above, the pressing roller assembly 76 rotates upward, causing the pressing roller 62 to pressingly contact the fixing roller 54 through the fixing belt 58. After the pressing roller 62 pressingly contacts the fixing roller 54, the coil spring 82 is compressed, thereby pressing reliably the pressing roller 62 toward the fixing roller 54. Without the coil spring 82, there is no allowance in positioning of the pressing roller 62 when changing the position of the pressing roller 62. That is, the spring force of the coil spring 82 enables the pressing condition of the pressing roller 62 to change reliably between the first pressing state, the second pressing state, and so forth. The pressing roller 62 is biased (pressed) by the upper end of the coil spring 82.

According to the foregoing embodiments, the pressing position of the pressing roller 62 is changed in multiple levels, for example, the first pressing state suitable for fixing, for example, a relatively thin sheet, a no-coating sheet, and the like, and a second pressing state suitable for fixing, for example, a relatively thick sheet, a coat sheet, and the like. Alternatively, the pressing positions are not limited to two that is, the first pressing state and the second pressing state. The number of pressing positions may be increased by employing a stepless cam as the cam 77. In such a case, a data table for sheet types and proper pressing positions corresponding to the recording media sheets may be stored in a memory of a controller, and a proper pressing position may be selected in accordance with the types of the recording medium. An amount of rotation of the cam 77 to move the pressing roller 62 to a proper pressing position is obtained by adjusting the number of steps of the stepping motor serving as the drive source of the cam 77, for example.

According to the foregoing embodiments, the present invention is employed in the belt-type fixing device. However, the present invention may be employed in a heat-roller type fixing device and a device that conveys a sheet and supplies heat thereto.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing a toner image on a recording medium, comprising:

a fixing roller to rotate in a predetermined direction of rotation;

a pressing roller to rotate and contact an outer circumferential surface of the fixing roller to form a nip between the pressing roller and the fixing roller through which the recording medium bearing the toner image passes to fix the toner image on the recording medium with heat and pressure, a position of the pressing roller changeable relative to the fixing roller;

at least one of a sheet guide disposed upstream from the nip in the direction of conveyance of the recording medium, to guide the recording medium to the nip;

a sheet separation plate disposed downstream from the nip in the direction of conveyance of the recording medium, to separate the recording medium from the pressing roller; and an electric component module; and a sheet discharger rotatably supported and disposed downstream from the sheet separation plate in the direction of conveyance of the recording medium, to discharge the recording medium separated from the pressing roller by the sheet separation plate, at least one of the sheet guide, the sheet separation plate, and the electric component module moving in conjunction with movement of the pressing roller as a single integrated unit without changing relative positions with respect to the pressing roller.

2. The fixing device according to claim 1, wherein the pressing roller includes an internal heater, and the electronic component module includes a temperature detector to detect the temperature of the surface of the pressing roller.

3. The fixing device according to claim 2, wherein the temperature detector detects the temperature of the surface of the pressing roller without contacting the pressing roller.

4. The fixing device according to claim 1, wherein the pressing roller includes an internal heater, and the electronic components module includes an overheat prevention member to shut off power supply to the heater when the temperature of the surface of the pressing roller exceeds a permissible threshold value.

5. The fixing device according to claim 1, wherein an upstream end portion of the sheet discharger in the direction of conveyance of the recording medium moves in conjunction with the sheet separation plate.

6. The fixing device according to claim 5, further comprising a biasing member to bias the sheet discharger against the sheet separation plate to contact the sheet separation plate.

7. The fixing devise according to claim 6, wherein the biasing member is a tension spring.

8. The fixing device according to claim 5, wherein the sheet discharger contacts the sheet separation plate under its own weight.

9. The fixing device according to claim 1, further comprising:

an upper frame including the fixing roller;

a pressing roller assembly including the pressing roller and at least one of the sheet guide, the sheet separation plate, and the electric component module as a single integrated unit;

a lower frame to rotatably support the pressing roller assembly; and a cam to rotate the pressing roller assembly to change a position of the pressing roller relative to the fixing roller.

10. The fixing device according to claim 9, wherein the cam changes gradually an amount of rotation of the pressing roller assembly.

11. The fixing device according to claim 10, wherein the cam is a stepless cam.

12. The fixing device according to claim 9, further comprising:

a shaft;

a first lever moved by the cam, to rotate the pressing roller assembly about the shaft;

a second lever to hold the pressing roller and rotate about the same shaft as the first lever; and an elastic member disposed between the first lever and the second lever, to exert a pressing force in a direction of the pressing roller pressing against the fixing roller when the pressing roller contacts the fixing roller due to rotation of the pressing roller assembly.

13. The fixing device according to claim 12, wherein the elastic member is a coil spring.

14. An image forming apparatus, comprising the fixing device according to claim 1.

* * * * *